United States Patent [19]

Isomura et al.

[11] 4,437,446

[45] Mar. 20, 1984

[54] ELECTRONICALLY CONTROLLED FUEL INJECTION SYSTEM

[75] Inventors: Shigenori Isomura; Akio Kobayashi; Katsushi Kato, all of Kariya; Ichiro Kowada; Sachio Nishii, both of Toyota, all of Japan

[73] Assignees: Nippondenso Co., Ltd., Kariya; Toyota Jidosha Kogyo Kabushiki Kaisha, Toyota, both of Japan

[21] Appl. No.: 358,923

[22] Filed: Mar. 17, 1982

Related U.S. Application Data

[63] Continuation of Ser. No. 155,385, Jun. 2, 1980, abandoned.

[30] Foreign Application Priority Data

Jun. 27, 1979 [JP] Japan ..... 54-81663

[51] Int. Cl.[3] ..... F02B 3/00

[52] U.S. Cl. ..... 123/492; 123/493

[58] Field of Search ..... 123/492, 493

[56] References Cited

U.S. PATENT DOCUMENTS

| | | | |
|---|---|---|---|
| 2,911,966 | 11/1959 | Pribble | 123/492 |
| 3,623,459 | 11/1971 | Gordon | 123/492 |
| 3,670,706 | 6/1972 | Fujisawa | 123/492 |
| 3,842,811 | 10/1974 | Shinoda | 123/492 |
| 4,127,086 | 11/1978 | Harada | 123/493 |
| 4,184,458 | 1/1980 | Aoki | 123/493 |
| 4,191,137 | 3/1980 | Williams | 123/493 |
| 4,227,507 | 10/1980 | Takase | 123/492 |
| 4,240,383 | 12/1980 | Horbelt | 123/493 |
| 4,335,696 | 6/1982 | Schrurle | 123/493 |

*Primary Examiner*—Ronald B. Cox

*Attorney, Agent, or Firm*—Cushman, Darby & Cushman

[57] ABSTRACT

An electronically controlled fuel injection system including an air flow sensor disposed in the intake pipe of an internal combustion engine upstream of its throttle valve to detect the amount of air flow to the engine and a control unit responsive to the output signal of the air flow sensor to adjust the amount of fuel to be supplied to the engine, is further provided with a fuel enrichment circuit responsive to the output signal of the air flow sensor whereby when the amount of air flow changes in a direction to decrease, a signal commanding an increase in fuel amount which is proportional to the rate of the change is fed to the control unit. The fuel enrichment circuit has an upper limit value such that the increase in fuel amount is prevented from exceeding an amount corresponding to the upper limit value. The fuel enrichment circuit is adapted so that the amount of fuel is not increased when the rate of change of the air flow in the decreasing direction is smaller than a predetermined lower limit value.

3 Claims, 5 Drawing Figures

ELECTRONICALLY CONTROLLED FUEL INJECTION SYSTEM

This is a continuation of application Ser. No. 155,385 filed June 2, 1980 now abandoned.

BACKGROUND OF THE INVENTION

The present invention relates to improvement in electronically controlled fuel injection systems for internal combustion engines.

A known system of this type is constructed as shown in FIG. 1 so that an air flow sensor 2 for measuring the amount of air flow to an engine generates an electric signal $V_S$ corresponding to the displaced position of a baffle plate 4 disposed in an intake pipe or manifold 3 of the engine, and the electric signal is applied to a control circuit 6 which in turn controls the duration of opening of fuel injection valves 7 or the amount of fuel injected into the engine.

In the FIG. 1, when a throttle valve 5 is closed rapidly or in a manner close to the rapid closing upon deceleration of the engine, due to the inertia of the air flowing through the baffle plate 4 of the air flow sensor 2 just before the rapid closing, a certain amount of air momentarily flows from the downstream side of the baffle plate 4 into a portion A upstream of the throttle valve 5 so that the pressure in the portion A is increased and a force having a direction indicated by an arrow B in the Figure is applied to the baffle plate 4. Thus, the baffle plate 4 is displaced in a direction tending to decrease the amount of air flow, generating a signal $V_S$ which is not corresponding to the actual amount of air flow to the engine (namely, a signal indicative of an air quantity smaller than the actual air flow rate) and then its output returns to the normal condition. Thus, in such a case, the ratio of air quantity to fuel quantity or the air-fuel ratio (hereinafter referred to as an A/F ratio) first deviates to the large (or lean) side of the desired value so that the engine misfires or the engine nearly misfires and the output torque of the engine decreases, and then at the expiration of a certain time the output signal returns to the normal condition so that the torque is increased, thus moving the vehicle jerkily and causing a feeling of unpleasantness on the part of the driver. Another disadvantage is that the occurrence of engine misfiring results in the emission of harmful exhaust gases. FIG. 2 (*a*), (*b*) and (*c*) respectively show variations in the amount of the throttle valve opening, in the amount of air flow to the engine and variations in the output signal of the air flow sensor 2 in relation to time axis. When the throttle valve 5 is closed rapidly at a time X as shown in (a) of FIG. 2, the amount of air flow to the engine does not change rapidly as shown in (b) of FIG. 2 due to a large volume of the portion between the throttle valve 5 and the engine intake valves. However, while there will be no problem if the output signal $V_S$ of the air flow sensor 2 varies as shown by the broken line in (c) of FIG. 2, the signal in fact varies as shown by the solid line in (c) of FIG. 2 for the previously mentioned reasons and the A/F ratio deviates to the large side by an amount corresponding to the hatched portion. The air flow sensor 2 is so designed that a voltage $V_S$ is generated which is proportional to the opening angle of the baffle plate 4, that is, the opening angle is increased with an increase in the amount of air flow to the engine and the resulting output voltage ia also increased with respect to the ground potential, whereas the output voltage is decreased with a decrease in the amount of air flow to the engine.

In addition, the time corresponding to the hatched portion of the output signal of the air flow sensor 2 shown in (c) of FIG. 2 varies depending on the operating conditions of the engine. FIG. 3 shows variations in the A/F ratio upon deceleration according to different rates of deceleration. The starting point of deceleration is indicated at X as in the case of FIG. 2. When the engine is decelerated from a constant speed driving operation, the A/F ratio slightly deviates to the large side as shown by the curve A, whereas when the engine is decelerated rapidly after a rapid acceleration or under a condition which may be considered to be the severest one the A/F ratio deviates to the large side very greatly as shown by the curve C and also the drivability is deteriorated. Each of the A/F curves attains the highest magnitude immediately after the deceleration and it comes nearer to the correct normal value with the lapse of time.

SUMMARY OF THE INVENTION

With a view to overcoming the foregoing deficiencies in the prior art, it is the object of the invention to provide an electronically controlled fuel injection system so designed that the output signal of an air flow sensor is applied to the system whereby when the amount of air flow to the engine changes in a direction to decrease, an output signal is generated which is proportional to the rate of the change and the amount of fuel is increased according to the output signal, thereby eliminating the danger of a situation arising in which the A/F ratio deviates to the large side and the engine misfires, improving the drivability and reducing the emission of harmful exhaust gases.

DESCRIPTION OF THE PREFERRED EMBODIMENT

Figure 1:
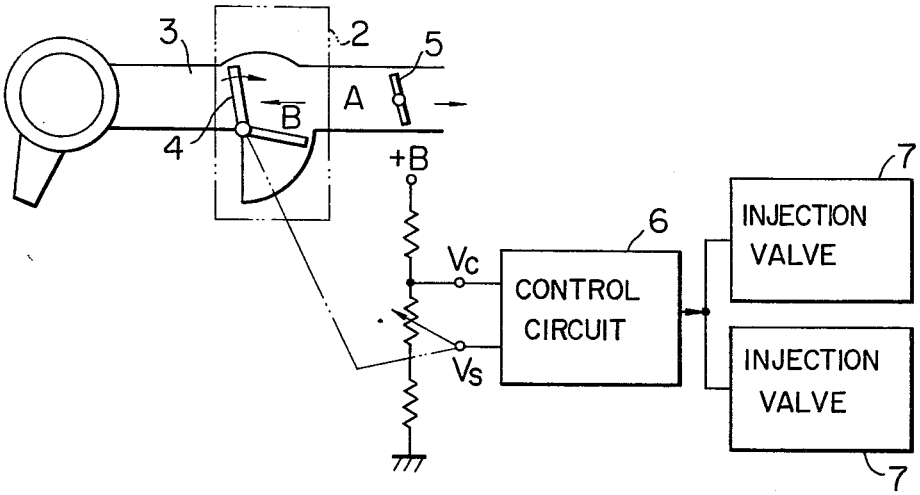
FIG. 1 is a schematic diagram of air flow sensor and control circuit useful for explaining the present invention.
Figure 2:
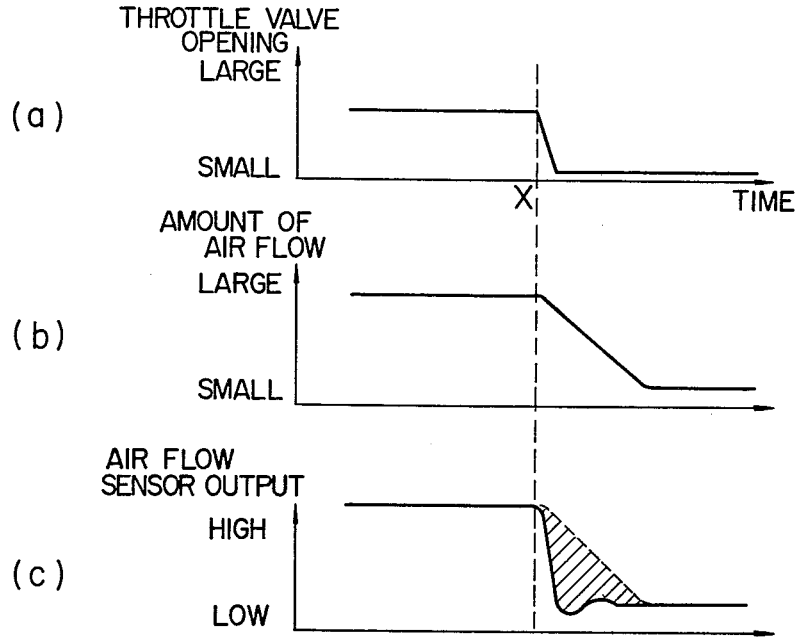
FIGS. 2 and 3 are characteristic diagrams useful are explaining the present invention.
Figure 3:
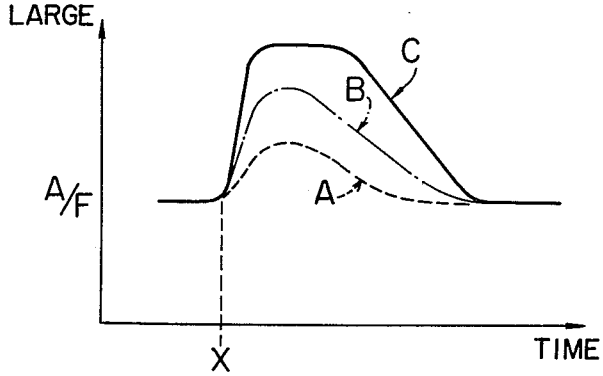
Figure 4:
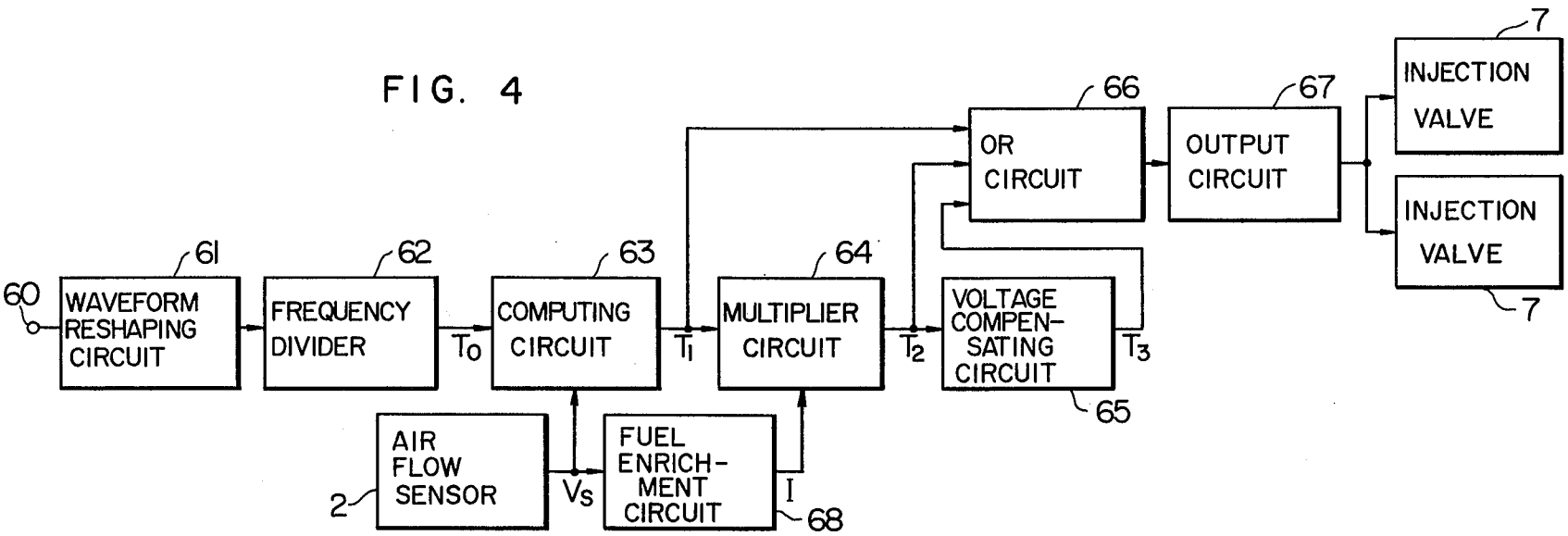
FIG. 4 is a block diagram showing an embodiment of a control circuit according to the present invention.

The present invention will now be described in greater detail with reference to the illustrated embodiment. In this embodiment, an air flow sensor 2 is identical in construction with that shown in FIG. 1 and it may be of a potentiometer type which generates a voltage corresponding to the amount of air flow to the engine. An embodiment of a control circuit 6 of this invention which is adapted for computing the amount of fuel injection will now be described with reference to FIG. 4. In the Figure, numeral 60 designates a terminal for detecting the speed of the engine from the output voltage waveform of the ignition coil primary, 61 a waveform reshaping circuit, 62 a frequency divider, 63 a computing circuit, 64 a multiplier circuit, 65 a voltage compensating circuit, 66 an OR circuit, 67 an output circuit connected to electromagnetic injection valves 7, and 68 a fuel enrichment circuit responsive to the detection voltage $V_S$ from the air flow sensor 2 so as to detect the rate or speed of closing of the throttle valve and determine the ratio of enrichment for the fuel injection amount in accordance with the valve closing rate.

Many parts of the above-described control circuit are like in construction with those disclosed for example in U.S. Pat. No. 3,898,964. The following explanation is particularly made of that of the fuel enrichment circuit 68, and the general operation of the control circuit is now described briefly. The ignition coil primary voltage waveform applied to the terminal 60 is reshaped by the waveform reshaping circuit 61 and it is then divided by the frequency divider 62 having a frequency dividing ratio selected to correspond to the number of times of fuel injection per engine revolution thus generating a pulse signal $T_0$ having a pulse width which is inversely proportional to the engine speed. The computing circuit 63 computes the desired fuel injection amount from the pulse signal $T_0$ and the detection signal $V_S$ from the air flow sensor 2, and a pulse signal $T_1$ is generated which is proportional to the amount of air flow and inversely proportional to the engine speed. The multiplier circuit 64 multiplies and compensates the pulse signal $T_1$ in accordance with signals corresponding to such engine parameters as engine cooling water temperature and air temperature and in accordance with a current output signal of the fuel enrichment circuit 68 so as to generate a pulse signal $T_2$, and the voltage compensating circuit 65 generates a pulse signal $T_3$ in response to the pulse signal $T_2$ to compensate for variation of the fuel injection amount caused by variation of the power supply voltage. These pulse signals $T_1$, $T_2$ and $T_3$ are added in time width by the OR circuit 66 and the electromagnetic valves 7 are opened by the output circuit 67 for the added time width. Each of the computing circuit 63 and the multiplier circuit 64 comprises a known type of monostable multivibrator having a variable time width and the time width of its output pulse signal increases with an increase in the externally supplied current thereto. As a result, if a rapid closing of the throttle valve is detected so that the fuel enrichment circuit 68 determines a supply current I to the multiplier circuit 64, upon the rapid closing of the throttle valve the multiplier circuit 64 generates a pulse signal $T_2$ having its time width increased in accordance with the current I.

Figure 5:
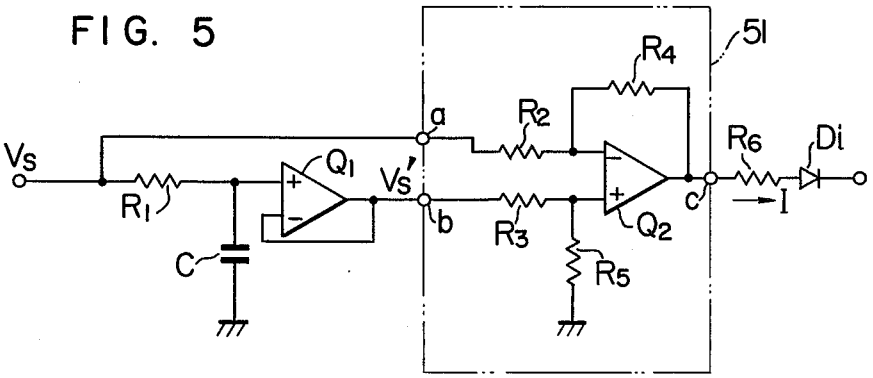
FIG. 5 is a circuit diagram of a fuel enrichment circuit shown in FIG. 4.

Next, the construction of the fuel enrichment circuit 68 will be described in detail with reference to FIG. 5. The fuel enrichment circuit 68 comprises resistors $R_1$, $R_2$, $R_3$, $R_4$, $R_5$ and $R_6$, a capacitor C, operational amplifiers $Q_1$ and $Q_2$ and a diode $D_i$. The detection voltage $V_S$ applied from the air flow sensor 2 is integrated by the resistor $R_1$ and the capacitor C and the integrated output is subjected to impedance transformation by the operational amplifier $Q_1$ whose output is applied to an input terminal b of a differential amplifier circuit 51 comprising the resistors $R_2$, $R_3$, $R_4$ and $R_5$ and the operational amplifier $Q_2$. If this voltage is represented as $V_S'$, then an output voltage $V_{out}$ at an output terminal c of the differential amplifier circuit 51 is given as follows $$V_{out}=(V_S'-V_S)\times A \quad (1)$$

where A is the voltage amplification factor of the differential amplifier circuit 51 which is given by $A=R_4/R_2$ with the condition of $R_2=R_3$ and $R_4=R_5$. On the other hand, the power supply for the operational amplifier $Q_2$ is connected to the battery which is not shown and its input terminals (+) and (−) respectively receive the battery voltage $V_B$ and a zero voltage. Thus it will be apparent that the output voltage $V_{out}$ is confined in the range of from zero voltage to the battery voltage $V_B$.

As a result, if the throttle valve is closed rapidly so that the condition $V_S'-V_S \geqq V_B/A$ holds, the output voltage $V_{out}$ becomes equal to the battery voltage $V_B$ and thus it is limited to the predetermined upper limit value. In other words, if a large undershoot or the like of the air flow sensor 2 occurs, the output voltage $V_{out}$ is prevented from increasing indefinitely and making the A/F ratio excessively small. On the other hand, when the throttle valve changes in a direction to open so that $V_S'<V_S$, the output voltage $V_{out}$ becomes negative according to the equation (1). In fact, however, the output voltage $V_{out}$ is limited to zero voltage for the reasons mentioned previously. In other words, the differential amplifier circuit 51 generates its output voltage $V_{out}$ only when the throttle valve changes in a direction to close upon deceleration of the engine. The rate of fuel enrichment is dependent on the current I supplied to the multiplier circuit 64 shown in FIG. 4 as mentioned previously and the current I is given by the following equation if the forward voltage drop of the diode $D_i$ is represented as $V_F$ $$I=(V_{out}-V_F)/R_6 \quad (2).$$

Of course, if $V_{out}<V_F$, then $I=0$. Consequently, when the detection voltage $V_S$ changes so that $V_{out}<V_F$, the amount of fuel is not increased. In other words, the amount of fuel is not increased if the closing rate of the throttle valve is such that $V_S'-V_S<V_F/A$ (namely, if the rate of change of the air flow in a direction to decrease is less than such a lower limit value). Of course, it is possible to vary the present lower limit value by varying the number of diodes $D_i$.

Also, as will be seen from the equation (2), the current I is inversely proportional to the resistor $R_6$ and consequently it is possible to preset the rate of enrichment as desired by varying the resistance value of the resistor $R_6$.

It will thus be seen from the foregoing description that since the system of this invention comprises the fuel enrichment circuit which receives the output signal of the air flow sensor positioned in the intake pipe of an engine upstream of the throttle valve to detect the amount of air flow to the engine whereby, when the amount of air flow changes in a direction to decrease, a signal is generated which commands an increase in the amount of fuel in accordance with the rate of change of the air flow; therefore if the throttle valve is closed fully or closed nearly fully, it is possible to avoid such a danger that the output signal of the air flow sensor fails to accurately measure the amount of air flow to the engine and the A/F ratio deviates to the large side of a present value thus causing the engine to misfire or nearly misfire; and improved drivability and prevention of large amounts of harmful exhaust emissions are ensured. Moreover, since upper and lower limit values are preset for the rate of change of the amount of air flow, it is possible to generate any fuel enrichment signal which meets the requirement in terms of the A/F ratio upon deceleration of the engine and thus the amount of fuel can be increased to suit different deceleration operating conditions.

What is claimed is:

1. An electronically controlled fuel injection system for internal combustion engines comprising:

an air flow sensor including a potentiometer for detecting an amount of air flow to an engine at a position upstream of a throttle valve disposed in an intake pipe of said engine and generating a corresponding output voltage;

control means including a controller having fuel injection amount compensating means responsive to said output voltage of said sensor to generate a pulse signal; and fuel injection valve means responsive to said pulse signal from said controller to inject said engine with an amount of fuel corresponding to a pulse width of said pulse signal; and a fuel enrichment circuit responsive to said output signal of said air flow sensor for feeding, when said amount of air flow changes in a direction to decrease, a signal commanding an increase in fuel amount which is proportional to the rate of said change to said compensating means, said fuel enrichment circuit including a delay circuit comprising a resistor and a capacitor for generating an output voltage indicative of a change in said sensor output voltage with a predetermined delay, a buffer amplifier for delivery said delay circuit output voltage, and a differential amplifier circuit for receiving and differentially amplifying said air flow sensor output voltage and buffer amplifier output voltage, whereby the rate of increase in said fuel injection amount is proportional to said difference between the sensor output voltage and the buffer amplifier output voltage.

2. An electronically controlled fuel injection system for internal combustion engine comprising:

sensor means for responding to displacement of a baffle plate disposed upstream of a throttle valve in an engine intake pipe and generating an output signal indicating an apparent amount of intake air flow to the engine;

control means, including fuel enrichment means, for controlling an amount of fuel injected in response to said output signal;

wherein said fuel enrichment means comprises:

first means, including means for delaying the sensor output signal and means for detecting a difference between the sensor output signal and the delayed output signal, for generating a fuel increase signal in proportion to the detected difference and in response to rate of change of said output signal decreasing on sudden closing operation of said throttle valve on engine deceleration, and the rate of increase in said fuel injection amount being proportional to said difference between the sensor output signal and the delayed output signal; and second means for increasing the controlled amount of fuel injected in response to said fuel increase signal in order to cause an optimum amount of fuel to be injected for an actual amount of intake air flow possibly different from said apparent amount of intake air.

3. A system according to claim 2, wherein said enrichment means further comprising third means for generating said fuel increase signal in the form of a unidirectional amplitude variable signal having an upper limit only in response to the decreasing change of said output signal on the closing operation of said throttle valve, and fourth means for setting said first means non-responsive to change of said output signal in direction of opening said throttle valve.

* * * * *